United States Patent [19]

Hellman

[11] Patent Number: 4,953,343

[45] Date of Patent: Sep. 4, 1990

[54] MACHINE FOR PACKAGING FLAT, UNSYMMETRICAL OBJECTS

[75] Inventor: Stig Hellman, Vällingby, Sweden

[73] Assignee: Akerlund & Rausing Licens Aktiebolag, Jarfalla, Sweden

[21] Appl. No.: 278,440

[22] PCT Filed: Mar. 18, 1988

[86] PCT No.: PCT/SE88/00136

§ 371 Date: Nov. 18, 1988

§ 102(e) Date: Nov. 18, 1988

[87] PCT Pub. No.: WO88/07471

PCT Pub. Date: Oct. 6, 1988

[30] Foreign Application Priority Data

Mar. 26, 1987 [SE] Sweden ..... 8701268

[51] Int. Cl.[5] ..... B65B 35/44; B65B 35/56; B65B 57/20; B65B 65/08

[52] U.S. Cl. ..... 53/500; 53/501; 53/544; 198/399; 198/453

[58] Field of Search ..... 53/501, 539, 147, 525, 53/500, 544; 198/399, 382, 426, 453, 454

[56] References Cited

U.S. PATENT DOCUMENTS

| | | | |
|---|---|---|---|
| 2,950,894 | 8/1960 | Hillman | 53/525 X |
| 3,143,223 | 8/1964 | McIntyre et al. | 53/544 X |
| 3,310,151 | 3/1967 | Carter | 198/453 X |
| 3,535,847 | 10/1970 | Strohmeier et al. | 53/501 |
| 3,729,895 | 5/1973 | Kramer et al. | 53/501 |
| 3,730,386 | 5/1973 | Monsees | 53/500 X |
| 3,734,268 | 5/1973 | Burger et al. | 198/399 X |
| 3,877,199 | 4/1975 | Lipes | 53/501 |
| 4,069,644 | 1/1978 | Danielsen | 53/501 |
| 4,081,069 | 3/1978 | Ono | 198/399 X |
| 4,265,072 | 5/1981 | Egli | 53/501 |
| 4,356,682 | 11/1982 | Mancini | 53/501 X |
| 4,512,137 | 4/1985 | Koberlein | 53/544 X |
| 4,514,959 | 5/1985 | Shroyer | 53/525 X |
| 4,623,059 | 11/1986 | Agnew | 198/453 X |
| 4,708,234 | 11/1987 | Born et al. | 198/453 |

FOREIGN PATENT DOCUMENTS 1182584 11/1964 Fed. Rep. of Germany .

*Primary Examiner*—Horace M. Culver

[57] ABSTRACT

Apparatus for feeding a preselected number of unsymmetrical objects into a package has a vibratory transporter for feeding a predetermined number of objects to be packaged into a collector and a photoelectric device for releasing the objects from the collector into a package when the predetermined number of objects are in the collector. The transporter includes a discharge trough which is slopped to one side and has a fixed siderail and a resiliently yieldable siderail which prevent jamming of unsymmetrical objects within the trough. Tracks which feed objects from an object storage unit to the trough are arranged one above the other so that the unsymmetrical objects cannot enter the trough on edge or in stacked relation to each other.

11 Claims, 4 Drawing Sheets

MACHINE FOR PACKAGING FLAT, UNSYMMETRICAL OBJECTS

This invention relates to a machine for packaging flat, non-rotation-symmetrical objects in bags or cardboard boxes, it being of importance that an exact preselected number of objects is released or fed into every package.

By flat, non-rotation-symmetrical objects is meant in this connection every object which has two substantially parallel sides and the intermediate sides of which have a non-circular periphery, e.g. an oval or elliptical periphery, or, especially, a triangular or polygonal periphery. The invention has been brought about especially in connection with problems of packaging tablets which have two parallel sides and an irregular triangular periphery, and in the subsequent figures the invention is illustrated with reference to such tablets. It is however apparent that this is only an example and that flat objects of many other non-rotation-symmetrical shapes give rise to the same problems capable of being solved by the same invention.

The said problems are, in the main, of two different types, all primarily due to the flat and non-rotation-symmetrical shape of the objects, i.e.

- that, on the one hand, the flat objects can on occasion mount and lie, two or several on top of one another or rise, two by two, on their edges.
- that, on the other hand, difficulties arise when it comes to calculating the number of objects fed down into every packaging unit, if the objects are on their edges or lying, two or several, on top of one another.

No known arrangements have solved the problems outlined above in a satisfactory manner.

The invention will now be described in greater detail with reference to the attached drawings, which show different parts of a complete filling unit.

In the drawings FIG. 1 shows the feeder of a filling unit in accordance with the invention seen in perspective from one direction.

Figure 7:
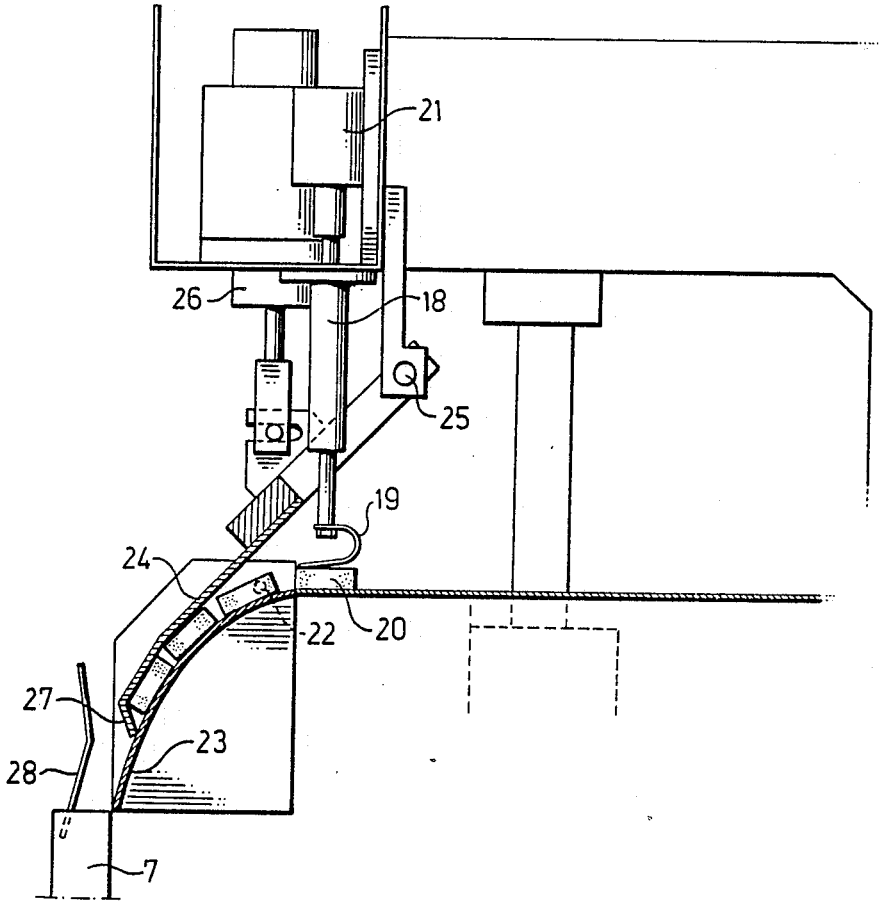

FIG. 7 finally shows a symptomatic cross-section through the output end of the machine with the apparatus for feeding an exact preselected number of objects into a package.

Figure 1:
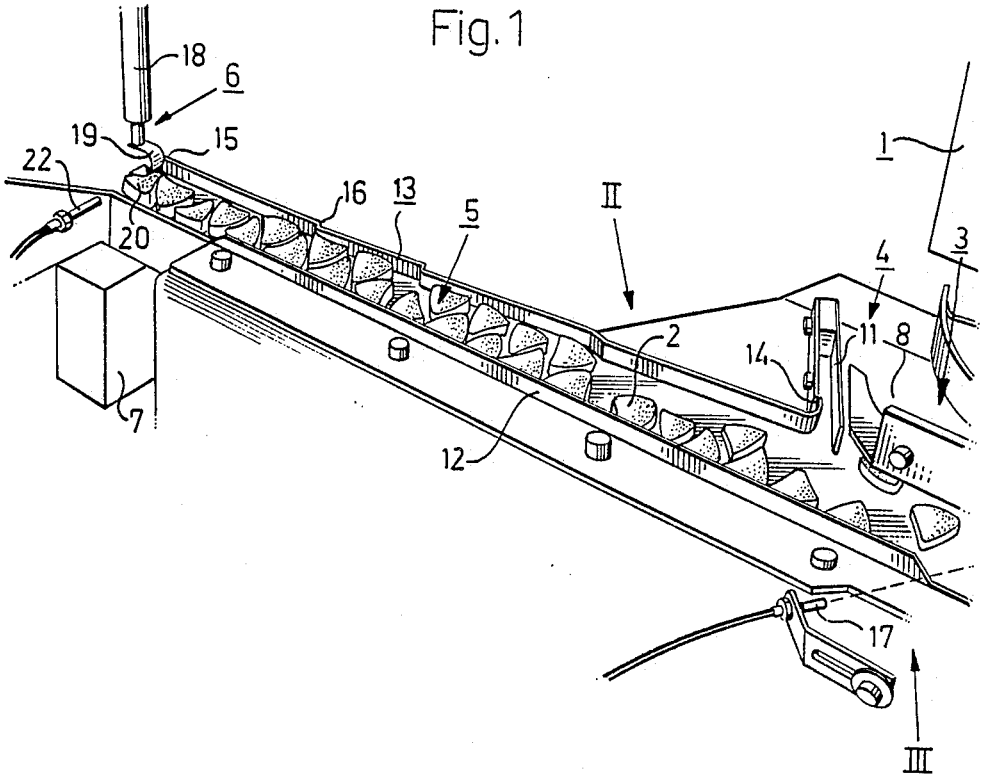
Figure 2:
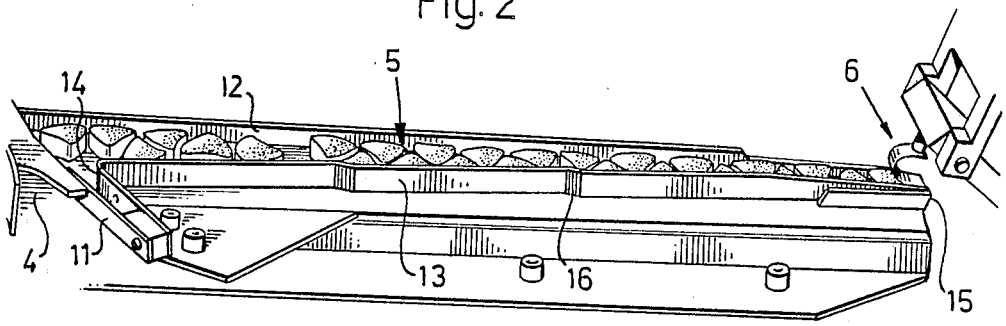
FIG. 2 shows the same arrangement seen along arrow II in FIG. 1.

The feeder shown in FIG. 1 consists in general of a schematically drawn magazine 1 for tablets 2, a rear transport trough or input channel 3, on which the tablets 2 are discharged from the magazine, a transfer unit 4, on which the tablets slip down from the input channel and are taken further to a front transport trough 5 on which a row of tablets is vibrated or in another way moved forward to a counting and discharge unit 6 which counts and releases a preselected number of tablets into a package 7.

Figure 3:
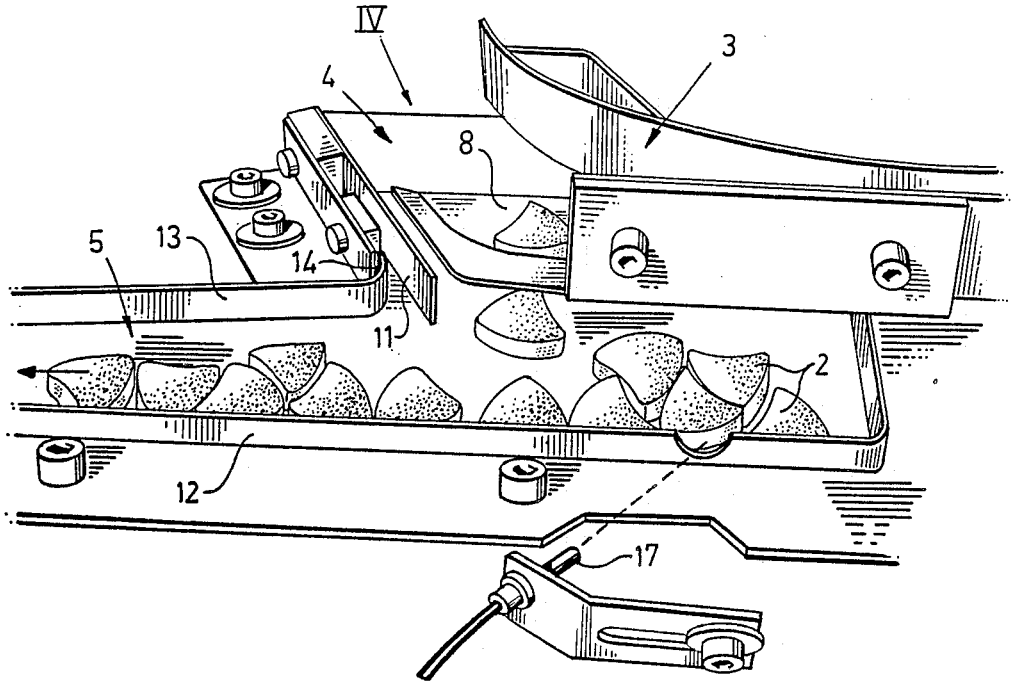
FIG. 3 shows in greater detail the initial part of the feeder as seen along arrow III in FIG. 1.
Figure 4:
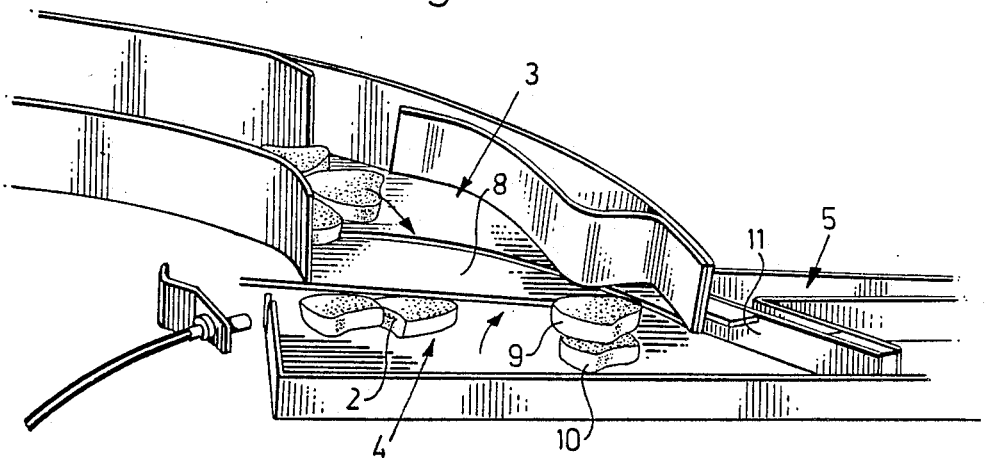
FIG. 4 shows in corresponding manner the same detail along arrow IV in FIG. 3.

As shown most clearly in FIGS. 3 and 4, the rear transport trough or input channel 3 is curved and has a bottom track 8 sloping downwards towards the transfer unit 4 and has its bottom 8 arranged at a height above the transfer unit which is somewhat larger, e.g. 1.5 times as large as the distance between the two parallel sides of tablet 2, since in this case the machine is assumed to handle the tablets as they lie on one of the parallel sides. Bottom track 8 on input channel 3 forms, on the other hand, a stripper for such tablets, e.g. tablet 9 in FIG. 4, which happens to be located on top of another tablet 10. Only one layer of tablets can therefore pass from transfer unit 4 towards the front transport trough 5.

Transfer unit 4 slopes downward towards the front transport trough 5, e.g. at an angle of about 18°, and it is shown arranged in such a manner as to guide the tablets in a direction opposite to that on input channel 3 and, accordingly, also slopes in the direction opposite to that of bottom track 8 of the input channel. The tablets have a tendency to slide down towards the more remote edge of unit 4 and at that end of the transfer unit there is therefore a spring plate 11 fixed at one end, the purpose of which is to act in the manner of a spring on tablets and while separating them guides them towards the front transport trough 5.

The tablets therefore slide one by one and in good order down towards front transport trough 5, which slopes in the same direction as the transfer unit, and in the case shown down towards a fixed bar 12 leading to the counting and discharge unit 6. The opposite side of the transport trough is formed by a spring bar 13 which is fixed only at its two ends 14 and 15 and is movable between these ends, and which is zig-zag shaped inasmuch as at a number of points 16, in the case shown at three different points, it is bent outward in steps. The front transport trough is slightly wider than the largest dimension of a tablet, and since the upper bar 13 in the front transport trough is springy, it contributes to the tablets being advanced in sequence one after the other, in spite of the fact that at the inlet of the somewhat tapering front transport trough they may be located in two rows. Tablets which still manage to be wedged fast against one another are given, thanks to the slight widening of the trough at the outward bent sections 16 of spring bar 13 the possibility of separating and releasing their grip on one another and of being guided in a row, one after the other.

For advancing the tablets in front transport trough 5, the latter may slope downward to some extent towards the counting and discharge unit, but with a preferred embodiment of the invention trough 5 extends horizontally and feeding is brought about with the aid of a vibrator arranged to vibrate transfer unit 4 and transport trough 5 in such a way that it vibrates tablets forward in the direction towards discharge unit 6, while discontinuing its vibration once the correct number of tablets has been counted or the trough has become empty. In order to observe when a shortage of tablets begins to develop in front transport trough 5, a photoelectric cell 17 is provided at the input end of trough 5, which is acted upon when a shortage of tablets arises and which, when this is the case, starts to vibrate several tablets forward. Once the trough is full of tablets, the light path of the photoelectric cell is interrupted, and vibration of the input channel ceases.

Figure 5:
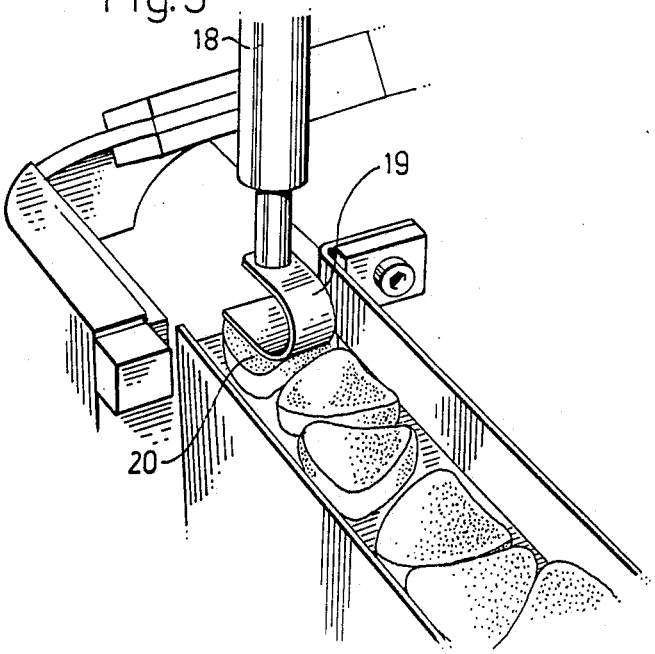
FIG. 5 shows a detail of the output end of the feeder.
Figure 6:
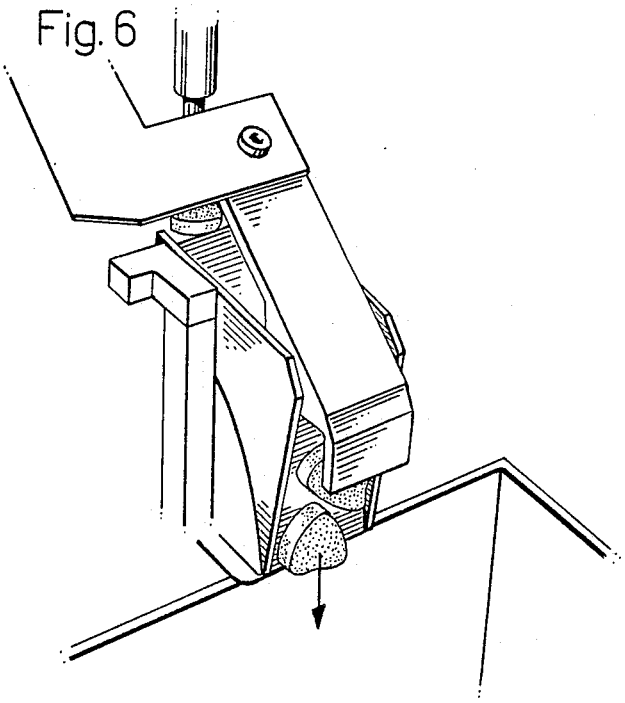
FIG. 6 shows a detail of the feeder seen from the further end of the machine.

Counting and discharge unit 6, which is shown best in FIGS. 5–7, consists of a stop unit, a counting unit and a collector with discharge device.

The stop unit consists of a stop plunger 18 with a leaf spring 19 at the bottom arranged in such a manner that when the stop plunger is projected downward it stops and presses fast the last tablet 20 in front transport trough 5, once a number of tablets has been collected in the counting unit. The stop plunger can be acted upon by an actuator 21 which co-operates with a counter with photoelectric cell 22 fitted directly after the stop unit, and which, once it has observed that a certain predetermined number of tablets has passed and been collected in a collector, issues a command to the effect that the stop cylinder 21 is to be acted upon, whereby e.g. a plunger in the actuator is projected until it makes contact with the last tablet in trough 5, which causes the entire stream of tablets to be stopped momentarily while at the same time issuing a command to the effect that all forward vibration of tablets is to stop.

The counting unit consists accordingly in photoelectric cell 22 which is connected, in known manner, to an electronic counter which in its turn is directly connected with the actuator or stop plunger 21.

The collector is designed with a downward curving discharge track 23 and a controlling device 24 co-operating with said track, which can be pivoted about a pin 25 and acted upon until the closed or open position of an actuator, e.g. a cylinder 26, is achieved, which is likewise connected to the same electronic device by way of a stop element and so arranged as to bring about opening of control device 24 as soon as the last tablet 20 has been stopped by stop plunger 18, whereby the tablets present in the collector drop down into a package 7 below discharge track 23. As soon as this is the case, control device 24 returns to the closed position and forms, with its end 27 bent downward and inward, a collecting chamber with track 23, in which the preselected number of tablets is collected, that number being adjusted and determined by the electronic control unit, and which is in the first place controlled by photoelectric cell 22, which marks the number of passing tablets by impulses. Discharge track 23 ends with its lower end in or near the upper edge of a package 7 and co-operates with another bar 28, which is controlled outside the releasing device and has the function to pull out slightly the remote side of package 7, while also forming a downward guiding surface which prevents a tablet from taking up a transverse position as it is delivered into the package of bag 7.

The arrangement described works as follows: Tablets 2 are delivered on to bottom track 8 of input channel 3. If at the inlet of front transport trough 5 the lightwave of photoelectric cell 17 indicates a shortage of tablets, the vibrator is started and the tablets 2 are vibrated down on to the transfer unit 4 and further down into front transport trough 5, so that this entire trough is filled with tablets. Photoelectric cell 17 controls the vibrator of input channel 3 irrespective of whether transport trough 5 vibrates or stands still. Bottom track 8 in input channel 3 prevents tablets from being taken down into the trough lying two or several on top of one another or upright on edge, and spring plate 11 contributes to orderly downward channelling of tablets in trough 5. The upper, springy bar 13, the "breathing bar" releases tablets which have managed to hook fast with their sides in one another, and the tablets arrive in an orderly row one after the other at the counting end discharge unit. A number of tablets selected at the electronic control unit drops down into collector 23–24. Once photoelectric cell 22 of the collector has indicated through impulses that the appropriate number of tablets has passed, stop plunger 18 is projected downward and its leaf spring 19 presses the last tablet 20 fast in trough 5 and thereby prevents any further advance of tablets. So as to prevent accumulations of tablets, vibration of the transport trough is discontinued at the same time. As soon as the stop plunger has gone down and stopped the flow of tablets, control device 24 is opened and the collected number of tablets drops down into a package 7, which in the meantime is advanced towards the filling position, and once the tablets have left the collector, control device 24 returns to its position in which it is closed in respect of discharge track 23, stop plunger 18 rises, the vibration is restarted and a new collection of tablets is fed down into the collector.

It is possible and appropriate to arrange a number of units of the type described in sequence one after the other, whereby the cardboard box or bag 7 passes from unit to unit until it is entirely filled. With this method, every unit feeds a certain proportion of the number of tablets which the cardboard box shall contain. If e.g. 16 tablets are to be delivered into a package, it is, for instance, possible to arrange five units one after the other, which in sequence deliver into the box e.g. 5-4-4-2-1 tablets, whereupon the box is closed and transported away in the usual manner.

It is understood that the above description and the embodiment of the invention as shown in the drawings constitutes only an illustrating example and that many different modifications and variations of the arrangement can occur within the framework of the following claims.

REFERENCE NUMBERS

1 Magazine
2 Tablets
3 Rear transport trough (input channel)
4 Transfer unit
5 Front transport trough
6 Counting and discharge unit
7 Package
8 Bottom track (3)
9 Tablet
10 Tablet
11 Spring plate (4)
12 Fixed bar (5)
13 Springy bar (5)
14 Input end
15 Output end
16 Outward bent section
17 Photoelectric cell
18 Stop plunger
19 Leaf spring
20 Last tablet (in 5)
21 Cylinder (18)
22 Photoelectric cell
23 Discharge track
24 Control device
25 Pin
26 Cylinder (24)
27 End (24)
28 Guide bar

What is claimed is:

1. Apparatus for packaging non-rotation-symmetrical objects with an exact preselected number of objects in each package, each object having at least one flat side on which the object is advanced, said apparatus comprising an object storage unit (1), a transport unit (3, 4, 5) for advancing objects received from the object storage unit (1) and having means (11, 13) for preventing objects from becoming jammed as the objects are advanced, a counting unit (22) for counting objects advanced by the transport unit (3, 4, 5), and a discharge unit (23, 24) for releasing a preselected number of objects advanced by the transport unit, characterized in that the transport unit (3, 4, 5) has means for preventing objects from being advanced one above another or on edge, the transport unit includes a front transport trough partially defined by opposing sidewalls and slopping toward one side, said sidewalls converging toward an output end having a width slightly larger than the largest dimension of an object to be packaged, said sidewalls including a fixed lower sidewall (12) and a resiliently yieldable upper sidewall (13), said upper sidewall (13) being outwardly yieldable when acted upon by objects in said trough.

2. Apparatus according to claim 1, characterized in that said discharge unit includes a collector (23, 24) for a definite counted number of objects, and control means for opening said collector when said definite number of objects is in said collector, whereby the objects are released down into an attached package (7).

3. Apparatus according to claim 2, characterized in that said discharge unit has a stop plunger (18) including a leaf spring (19) at its lower end, and means for projecting said stop plunger when a preselected number of objects have been released from said collector, said leaf spring pressing against the forwardmost object in said trough to hold said forwardmost object fast when said plunger is projected, and for retracting said plunger to release objects from said discharge unit into said collector (23, 24).

4. Apparatus according to claim 3, characterized in that said apparatus includes means for releasing objects from said collector when a predetermined number of objects are in said collector.

5. Apparatus according to claim 4, characterized in that said means for releasing objects from said collector comprises said means for projecting said stop plunger.

6. Apparatus as set forth in claim 3, characterized in that said means for projecting said plunger comprises a photoelectric cell (22) for marking by means of electrical impulses the number of passing objects.

7. Apparatus according to claim 3, characterized in that said apparatus includes a vibrating means for advancing articles in said transport unit and means for interrupting the operation of said vibrating means when said stop plunger is in its projected position.

8. Apparatus according to claim 1, characterized in that said transport unit includes an input channel (3) having a sloping bottom track (8) for receiving and advancing objects received from said storage unit (1), and a transfer track (4) for advancing objects received from said input channel (3) and sloping in a direction opposite to that of said input channel (3), said transfer track (4) extending inwardly below said channel (3), said means for preventing objects from being advanced one above another or on edge comprising the vertical spacing between the bottom (8) and an associated portion of said transfer track (4) below said bottom (8).

9. Apparatus according to claim 8, characterized in that one side of said transfer track (4) comprises a spring plate (11) which acts in the manner of a spring upon objects advanced on said transfer track (4).

10. Apparatus according to claim 8, characterized in that said transfer track (4) has one side formed by a spring plate (11) for acting in the manner of a spring upon objects on said track (4).

11. Apparatus according to claim 1, characterized in that said upper sidewall (13) comprises a spring plate fixed only at the beginning (14) and end (15) of said trough and formed with zig-zag-type outward bends (16).

* * * * *